United States Patent [19]

Marsh et al.

[11] Patent Number: 5,058,743

[45] Date of Patent: Oct. 22, 1991

[54] ANTISTATIC, LOW PARTICULATE SHIPPING CONTAINER FOR ELECTRONIC COMPONENTS

[75] Inventors: Harry H. Marsh, Beaverton; Terry L. Whalen, Hillsboro, both of Oreg.

[73] Assignee: Tektronix, Inc., Beaverton, Oreg.

[21] Appl. No.: 586,665

[22] Filed: Sep. 24, 1990

[51] Int. Cl.[5] ..... B65D 81/24

[52] U.S. Cl. ..... 206/331; 206/334

[58] Field of Search ..... 206/328–334; 361/331, 421

[56] References Cited

U.S. PATENT DOCUMENTS

| | | | |
|---|---|---|---|
| 4,026,412 | 5/1977 | Henson | 206/334 |
| 4,223,368 | 9/1980 | Dattilo | 206/328 |
| 4,241,829 | 12/1980 | Hardy | 206/328 |
| 4,274,537 | 6/1981 | Cooper | 206/329 |
| 4,494,651 | 1/1985 | Malcolm | 206/328 |
| 4,605,007 | 8/1986 | Heraly | 206/328 |
| 4,609,104 | 9/1986 | Kasper et al. | 206/328 |
| 4,712,674 | 12/1987 | Young | 206/328 |
| 4,722,025 | 1/1988 | Robinson | 206/328 |
| 4,767,003 | 8/1988 | Rice et al. | 206/334 |
| 4,865,197 | 9/1989 | Craig | 206/328 |
| 4,968,259 | 11/1990 | Korsunsky et al. | 206/331 |
| 4,977,483 | 12/1990 | Perretta | 206/328 |

FOREIGN PATENT DOCUMENTS

| | | | |
|---|---|---|---|
| 2103561 | 2/1983 | United Kingdom | 206/334 |

OTHER PUBLICATIONS

"Module Substrate Case", Avazian et al., IBM Disclosure Document, vol. 24, No. 1A, Jun. 1981.

"Protective Container For Integrated Circuit Modules", Capousis et al., IBM Disclosure Document, vol. 17, No. 10, Mar.-1975.

*Primary Examiner*—Jimmy G. Foster

*Attorney, Agent, or Firm*—Francis I. Gray

[57] ABSTRACT

An antistatic, low particulate shipping container for an electronic component having an open package design has a circuit board conductively plated on top and bottom with plated through holes in the configuration of the pins of the open package electronic component. Socket pins are press fitted into the through holes. The circuit board is secured within a conductive box so that the tips of the socket pins contact the conductive box and so that the edges of the circuit board are sealed. When the electronic component is mounted on the circuit board, the pins of the component are shorted together and to the conductive box to provide protection against ESD damage. A slide-on cover with an integral window is slipped over the electronic component to protect the exposed portion of the component from contact and to provide visual inspection of the component.

3 Claims, 2 Drawing Sheets

ANTISTATIC, LOW PARTICULATE SHIPPING CONTAINER FOR ELECTRONIC COMPONENTS

BACKGROUND OF THE INVENTION

The present invention relates to shipping packages for electronic components, and more particularly to an antistatic, low particulate shipping container that holds an electronic component in an open package design securely in place while protecting sensitive surfaces from particulate contamination.

Scientific charge-coupled device (CCD) imagers, as well as other types of electronic components, are very sensitive to electrostatic discharge (ESD) damage, particulate contamination and mechanical damage due to the open design of the CCD package. The CCDs are housed in an open metal package with exposed bond wires and the CCD surface on the top side, and metal pins protruding from the bottom side of the package. The CCD surface and bond wires can be damaged by finger contact, and the metal pins must be shorted together during transportation to prevent ESD damage.

Therefore what is desired is an appropriate shipping container for sensitive electronic components having an open package design that provides antistatic and low particulate protection for the electronic components.

SUMMARY OF THE INVENTION

Accordingly the present invention provides an antistatic, low particulate shipping container for electronic components that protects the electronic components from particulate and ESD caused damage. A conductive box has a circuit board mounted within on a bed of epoxy. The circuit board is metal plated on both sides with plated through holes corresponding to the pins of an electronic component. Socket pins are press fitted in the through holes and contact the conductive box through the epoxy when the circuit board is mounted in the box. A slide-on cover with an epoxy-sealed window is placed over the electronic component to protect the exposed surface, and when mounted on the circuit board the pins of the electronic component are shorted together via the socket pins to protect against ESD damage.

The objects, advantages and other novel features of the present invention are apparent from the following detailed description when read in conjunction with the appended claims and attached drawing.

DESCRIPTION OF THE PREFERRED EMBODIMENT

Figure 1:
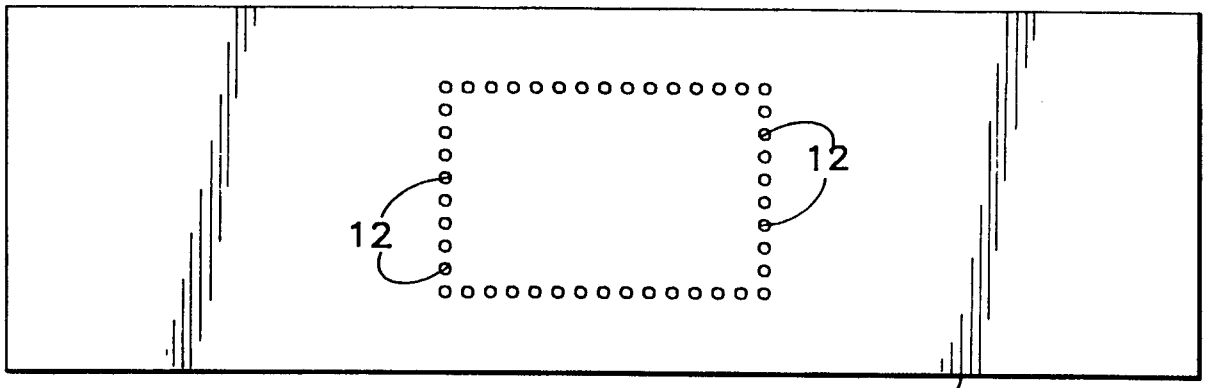
FIG. 1 is a top view of a circuit board according to the present invention.

Referring now to FIG. 1 an electronic circuit board (ECB) 10 is shown having a plurality of holes 12 therethrough corresponding to the pin configuration of an electronic component to be shipped. Although only one pin configuration is shown, the ECB 10 may have a plurality of sets of holes 12 corresponding to a plurality of standard pin configurations for electronic components. The ECB 10 is plated on both sides with a conductive material, and the through holes 12 also are plated to provide electrical continuity between the top and bottom of the ECB.

Figure 2:
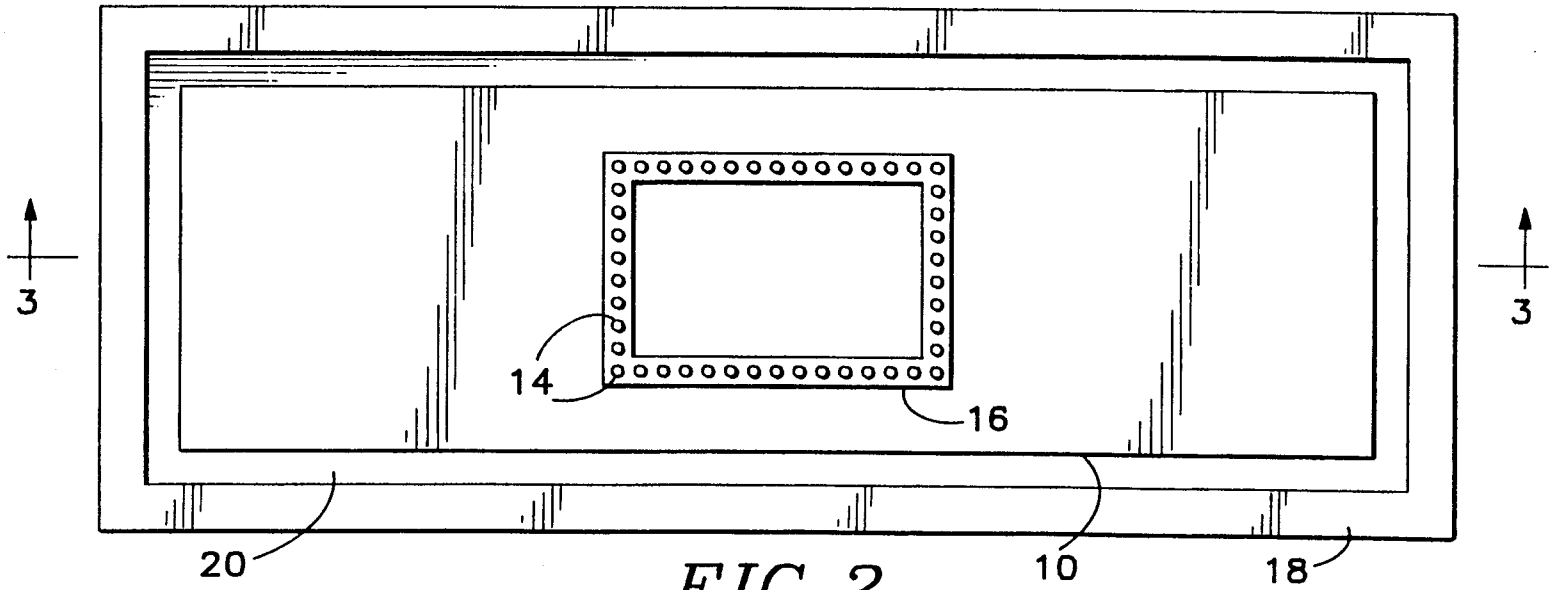
FIG. 2 is a top plan view of a shipping container according to the present invention with the cover removed.
Figure 3:
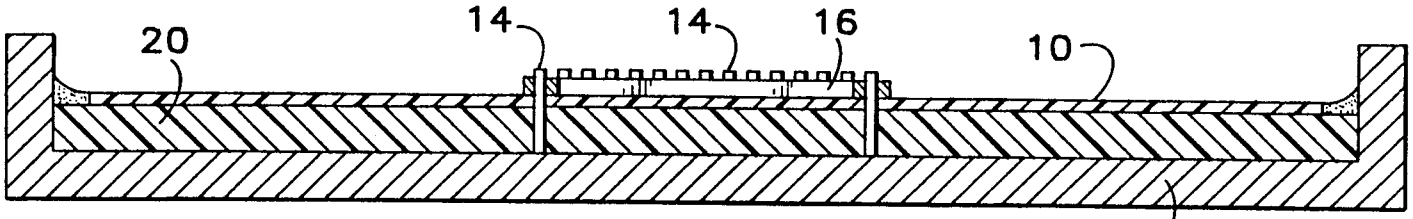
FIG. 3 is a cross-sectional view of the shipping container of FIG. 2 taken along line 3—3.
Figure 6:
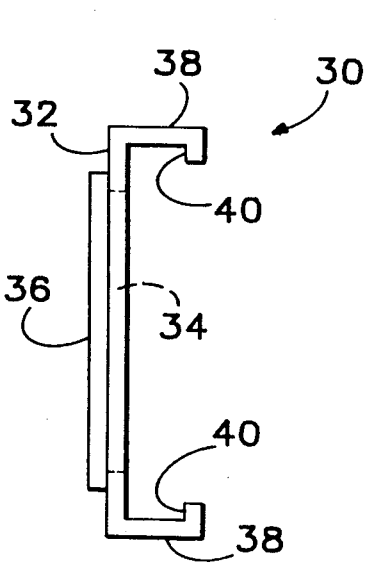
FIG. 6 is a side plan view of the slide-on cover of FIG. 5.
Figure 5:
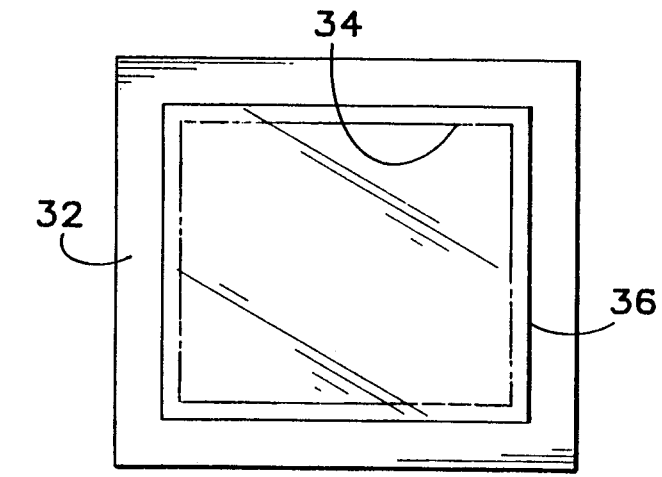
FIG. 5 is a top plan view of a slide-on cover for the CCD imaging device according to the present invention.

Socket pins 14, either individually or within a frame 16 as shown in FIG. 2, are press fitted through the holes 12 in the ECB 10. The ECB 10 with the socket pins 14 is secured within a conductive box 18 on an epoxy layer 20 so that the epoxy seals the edges of the ECB. The ECB 10 is pressed down sufficiently in the box 18 so that the socket pins 14 contact the box through the epoxy layer 20 as shown in FIG. 3.

Figure 4:
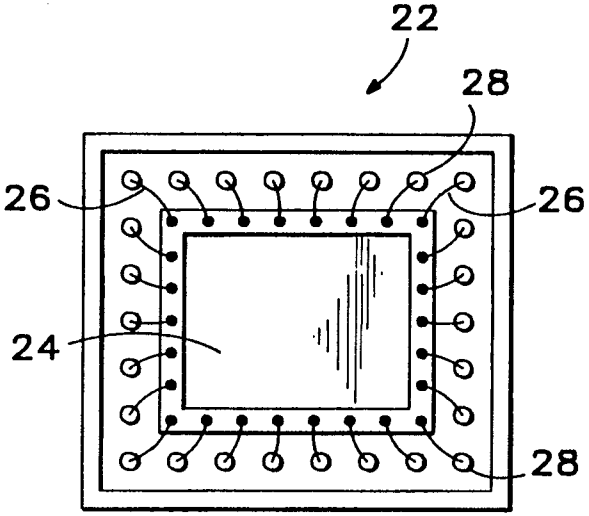
FIG. 4 is a top plan view of a CCD imaging device.

An open package electronic component 22, such as a CCD imaging device as shown in FIG. 4, has an exposed surface area 24 with bond wires 26 leading to appropriate conductive posts 28 situated around the perimeter of the surface area. The conductive posts 28 are contiguous with pins (not shown) that extend from the bottom of the package 22. When the package 22 is placed in the shipping container, the pins are inserted into the socket pins 14, shorting all the pins to each other and to the conductive box 18.

A slide-on cover 30 has a flat surface 32 with a large central aperture 34. An epoxy sealed window 36 is secured over the aperture 34. Although a heat cured epoxy may be used for sealing the window 36, thermal stresses are induced into the window due to differing thermal coefficients of expansion between the window glass and the metal frame. Therefore a room temperature epoxy is preferred. Slides 38 contiguous with the flat surface on two opposing sides of the cover 30 each have a lip 40 that engages the edge of the bottom of the open package 22 when the cover is slipped onto the package over the surface area 24. The window 36 provides for visual inspection of the surface area 24 without the necessity of exposing the surface area and bond wires 26 to particulate contamination. When the CCD imaging device 22 is removed from the shipping container, the cover 30 may be left in place during initial check-out of the system within which the device is to be used. Of course the cover 30 is removed before cooling the device 22 to operating temperatures.

Thus the present invention provides an antistatic, low particulate shipping container for an open package electronic component by securing a plated circuit board with press fitted socket pins within a conductive box so that the pins contact the box, and by providing a slide-on cover with a window for protecting the exposed surface area of the package while allowing visual inspection.

What is claimed is:

1. A shipping container for an open package electronic component having an exposed surface and contact pins comprising:

a conductive box; and a conductivity plated circuit board having press fitted conductive socket pins mounted thereon, the circuit board being securely mounted within the conductive box so that the conductive socket pins contact the conductive box to provide antistatic protection to the electronic component when mounted on the circuit board with the contact pins inserted into the conductive socket pins.

2. A shipping container as recited in claim 1 further comprising a slide-on cover for slipping over the open package electronic component to protect the exposed surface of the electronic component from particulate contamination.

3. A shipping container as recited in claim 2 wherein the slide-on cover includes an integral window to provide visual inspection of the exposed surface of the electronic component.

* * * * *